US010703090B2

(12) United States Patent
Frati et al.

(10) Patent No.: US 10,703,090 B2
(45) Date of Patent: Jul. 7, 2020

(54) APPARATUS AND METHOD FOR MOUNTING A PRINTING PLATE ON A PRINTING CARRIER

(71) Applicant: Bobst Firenze S.r.l., Campi Bisenzio (FI) (IT)

(72) Inventors: Ludovico Frati, Siena (IT); Matteo Cardinotti, Capannori (IT)

(73) Assignee: BOBST FIRENZE S.R.L. (IT)

( * ) Notice: Subject to any disclaimer, the term of this patent is extended or adjusted under 35 U.S.C. 154(b) by 111 days.

(21) Appl. No.: 15/558,359

(22) PCT Filed: Mar. 16, 2016

(86) PCT No.: PCT/IB2016/051484
§ 371 (c)(1),
(2) Date: Sep. 14, 2017

(87) PCT Pub. No.: WO2016/151436
PCT Pub. Date: Sep. 29, 2016

(65) Prior Publication Data

US 2018/0079200 A1 Mar. 22, 2018

(30) Foreign Application Priority Data

Mar. 20, 2015 (IT) ..... FI2015A0081

(51) Int. Cl.

| | |
|---|---|
| ***B41F 27/12*** | (2006.01) |
| ***B41F 27/00*** | (2006.01) |
| ***B41F 5/24*** | (2006.01) |
| ***B41F 27/14*** | (2006.01) |

(52) U.S. Cl.
CPC ..... *B41F 27/005* (2013.01); *B41F 5/24* (2013.01); *B41F 27/1206* (2013.01); *B41F 27/1275* (2013.01); *B41F 27/14* (2013.01); *B41P 2227/30* (2013.01); *B41P 2227/60* (2013.01); *B41P 2227/62* (2013.01)

(58) Field of Classification Search
None
See application file for complete search history.

(56) References Cited

U.S. PATENT DOCUMENTS 4,437,403 A * 3/1984 Greiner ..... B41F 13/14 101/248
4,553,478 A * 11/1985 Greiner ..... B41F 33/0027 101/181
4,743,324 A 5/1988 Boyce et al. ..... 156/215
(Continued)

FOREIGN PATENT DOCUMENTS

WO WO 96/04139 A1 2/1996

OTHER PUBLICATIONS

International Search Report dated May 19, 2016 in corresponding PCT International Application No. PCT/IB2016/051484.
(Continued)

*Primary Examiner* — Jill E Culler
(74) *Attorney, Agent, or Firm* — Ostrolenk Faber LLP

(57) ABSTRACT

For a flexographic printing apparatus, an apparatus (1) and method for mounting a printing plate (2) on a printing cylinder (4) or a printing sleeve including a system for pre-alignment (5, 8) of a printing plate (2) and real-time alignment (5, 8) of the printing plate (2) during mounting.

13 Claims, 4 Drawing Sheets

(56) References Cited

U.S. PATENT DOCUMENTS

| | | | | |
|---|---|---|---|---|
| 5,806,431 | A * | 9/1998 | Muth | B41F 27/005 101/415.1 |
| 6,571,708 | B1 * | 6/2003 | Rudzewitz | B41F 27/12 101/395 |
| 2008/0190312 | A1 * | 8/2008 | Schnell | B41F 27/005 101/485 |
| 2012/0272848 | A1 | 11/2012 | Leader, Jr. et al. | 101/415.1 |

OTHER PUBLICATIONS

Written Opinion dated May 19, 2016 in corresponding PCT International Application No. PCT/IB2016/051484.

* cited by examiner

APPARATUS AND METHOD FOR MOUNTING A PRINTING PLATE ON A PRINTING CARRIER

CROSS-REFERENCE TO RELATED APPLICATIONS

The present application is a 35 U.S.C. §§ 371 national phase conversion of PCT/IB2016/051484, filed Mar. 16, 2016, which claims priority of Italian Patent Application No. FI2015A000081, filed Mar. 20, 2015, the contents of which are incorporated by reference herein. The PCT International Application was published in the English language.

FIELD OF THE INVENTION

The invention relates to sector of printing apparatus, in particular flexographic printing apparatus, and more specifically to an apparatus and a method for mounting a printing plate on a printing cylinder or a printing sleeve (more generally speaking, a printing carrier), and comprising a system for pre-alignment of the printing plate.

BACKGROUND OF THE INVENTION

In automated flexographic printing methods a mounting apparatus is used which mounts a printing plate on a printing cylinder or a printing sleeve. During a first step, the printing plate is positioned on a work table of the mounting apparatus to be suitably aligned with the printing cylinder for a subsequent mounting operation. For this purpose, technical measures are employed for aligning the printing plate on the work table before mounting. In particular, some known mounting apparatuses, such as in US2012/0272848, comprise a movable work table which allows displacement of the printing plate resting on the table, so as to align the printing plate with the printing cylinder on which the printing plate will be mounted. In other known mounting apparatuses, instead, a manipulator device grips and displaces the printing plate resting on the work surface.

SUMMARY OF THE INVENTION

The object of the present invention is to provide a method and an apparatus for mounting a printing plate on a printing cylinder which allows, as compared to known systems mentioned above, more precise, reliable and repeatable alignment of a printing plate of any format with the printing cylinder, before and during mounting.

It is also an object of the present invention to provide a method and an apparatus of the aforementioned type which ensure efficient control of the force with which the printing plate is mounted on the printing cylinder, so as to allow laying of the printing plate with a constant tension.

These objects are achieved by the apparatus and method for mounting a printing plate on a printing cylinder according to the present invention.

BRIEF DESCRIPTION OF THE DRAWINGS

The characteristic features and advantages of the apparatus and method for mounting a printing plate on a printing cylinder according to the invention will be apparent from the following description of an embodiment thereof, provided as a non-limiting example with reference to the attached drawings in which.

DESCRIPTION OF AN EMBODIMENT

Figure 1:
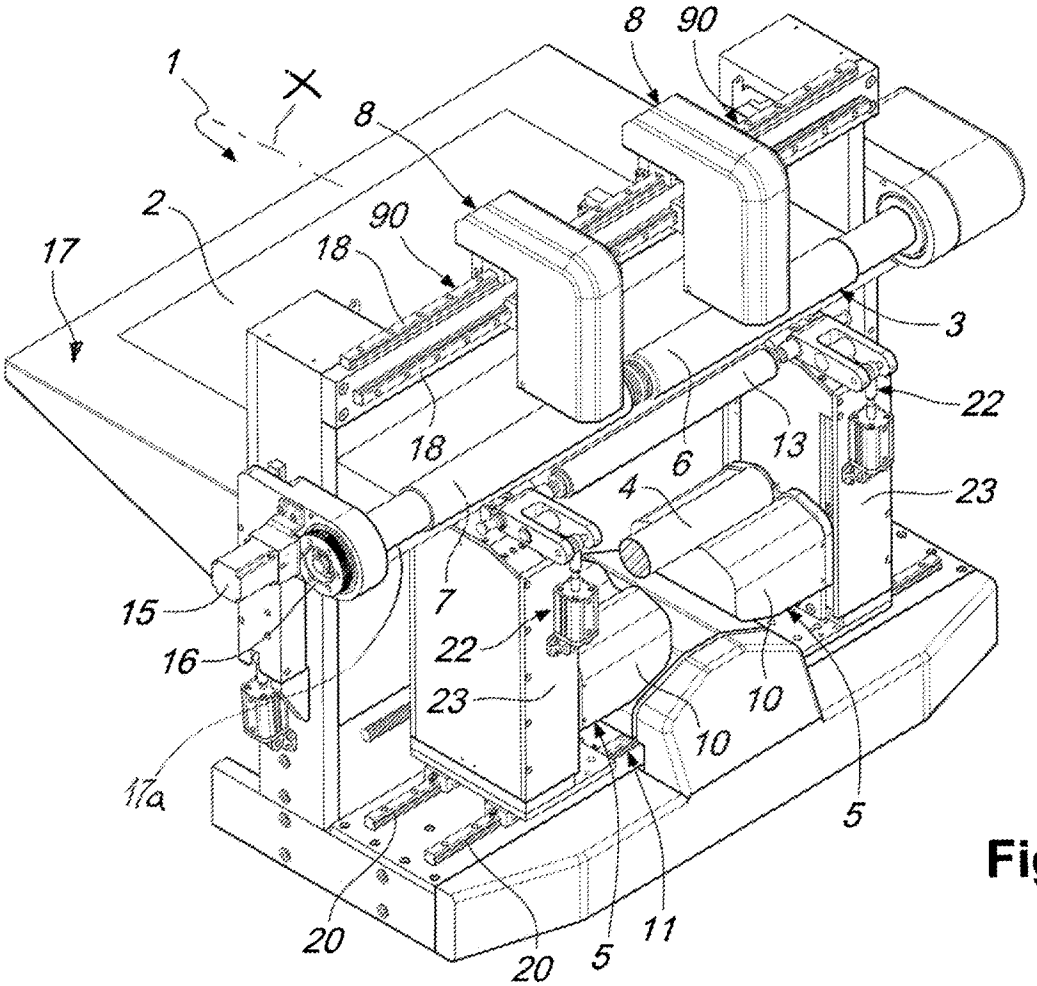
FIG. 1 is a perspective view of an apparatus for mounting a printing plate on a printing cylinder according to the invention.
Figure 2:
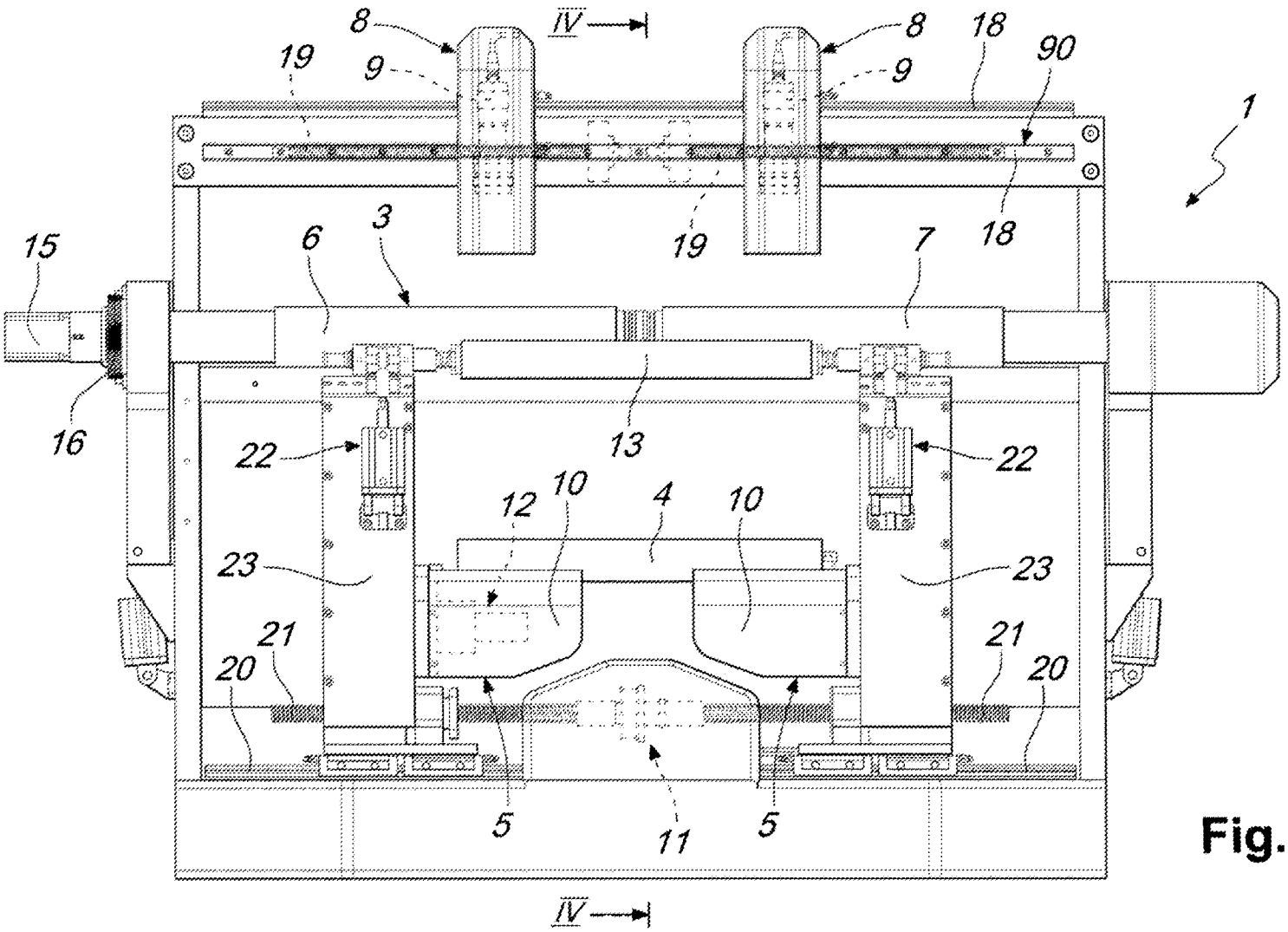
FIG. 2 is a front view of the apparatus according to FIG. 1, with some hidden parts left visible.
Figure 3:
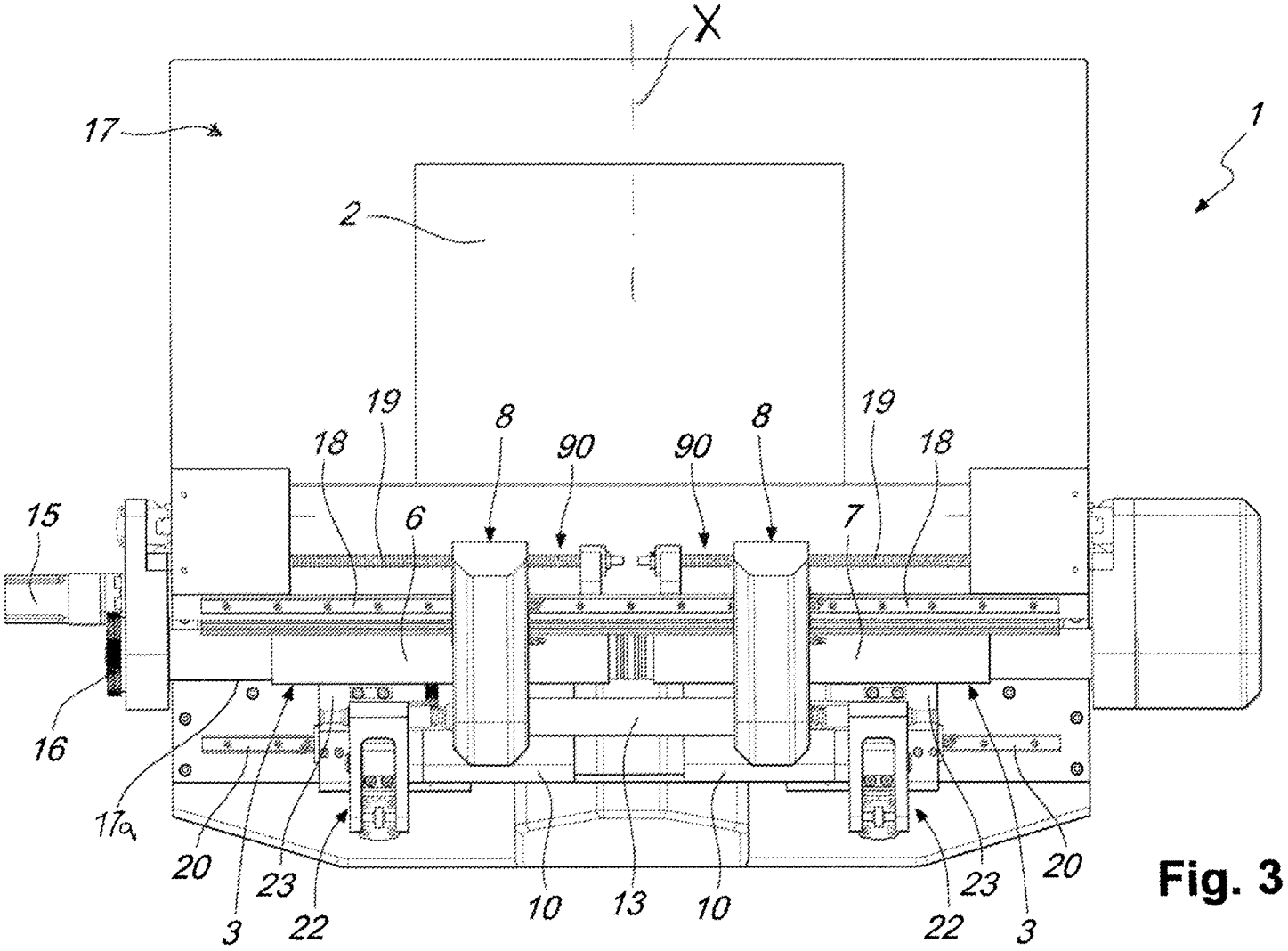
FIG. 3 is a top plan view of the apparatus according to FIG. 1.
Figure 4:
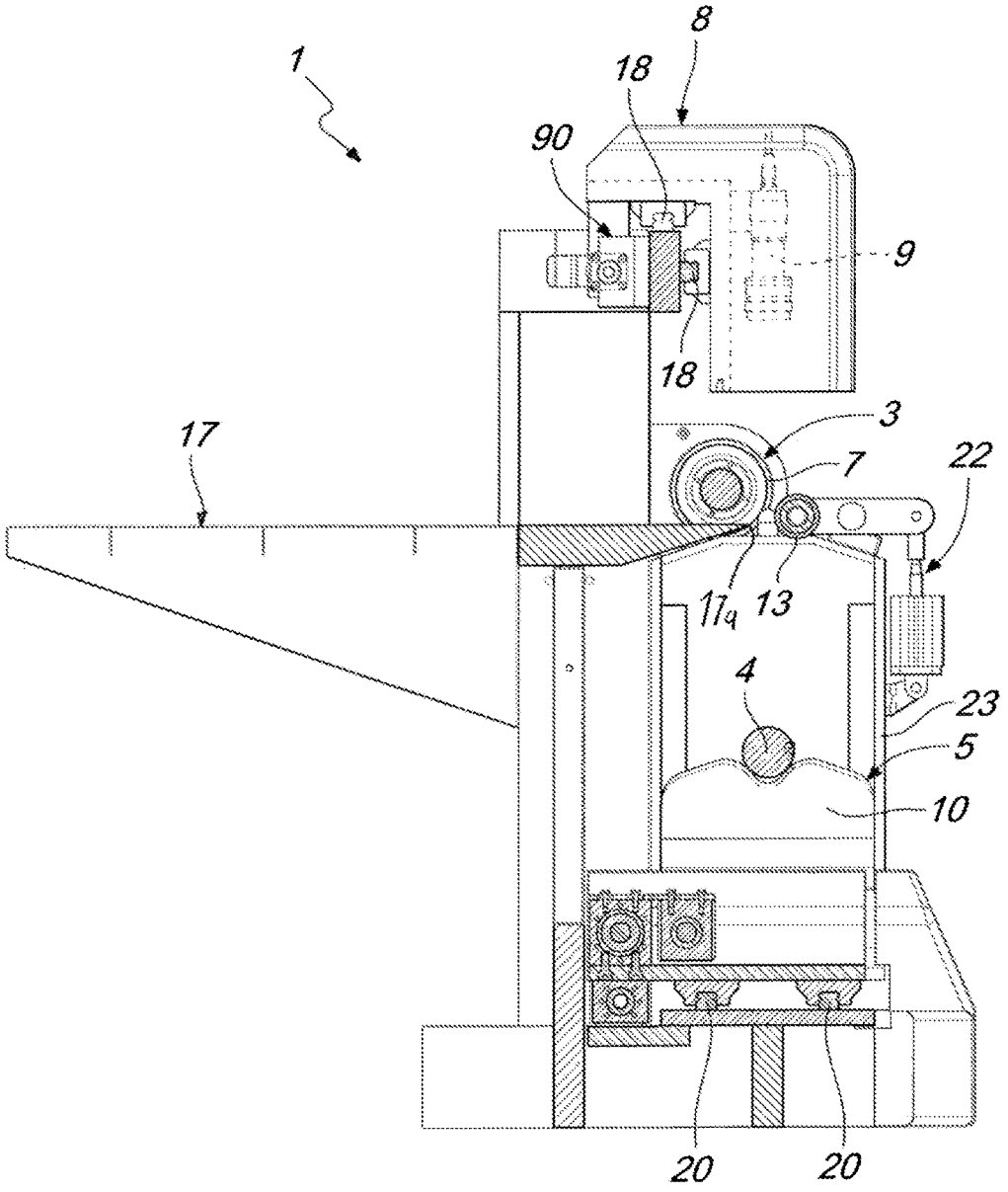
FIG. 4 is a cross-sectional view of the apparatus shown in FIG. 2 along the cross-sectional line IV-IV, with some hidden parts left visible.

With reference to the Figures, an apparatus for mounting a printing plate on a printing cylinder comprises a working surface 17, including an inlet side on which a printing plate 2 is to be mounted. The working surface is formed by a sheet or panel-like element with an approximately rectangular profile and the printing plate 2 is fed in the inlet side of the working surface.

A system 5 for supporting, aligning and driving a printing cylinder 4 is arranged in sequence and below the working surface 17. The alignment and driving system 5 is configured to move the printing cylinder 4 so as to align it with the printing plate 2 and cause rotation of the printing cylinder 4 for mounting the printing plate 2 on the printing cylinder 4. The apparatus 1 may alternatively comprise a printing sleeve instead of the printing cylinder 4. A stable connection between a printing plate and a printing cylinder (or sleeve) is performed by means of a double action adhesive film spread over the outer surface of the cylinder.

A system for pre-alignment of the printing plate 2 on the working surface 17 is denoted overall by the reference number 3. It comprises a pair of rotatable pressure rollers 6 and 7 powered independently of each other and configured and operable to align the printing plate 2 with respect to the position of the printing cylinder 4. Gripping of the rollers on the printing plate and consequent movement is performed using friction induced by the pressure rollers 6 and 7 on the printing plate 2 against the surface 17. For this purpose, the pressure rollers may advantageously comprise an outer layer comprised of material suitable for increasing the coefficient of tangential friction, for example rubber.

The pressure rollers 6 and 7 are arranged along an outlet side 17*a* where the printing plate exits from the surface 17 toward the system 5. Therefore, the cylinder 4 and the pressure rollers 6 and 7 are preferably coaxial and parallel with the aforementioned side. Each pressure roller 6, 7 is, advantageously driven by a respective motor 15 via suitable movement transmission means 16. Owing to the independent operation of the two pressure rollers 6 and 7, it is possible to achieve different speeds of rotation of the two rollers to obtain an angular displacement of the printing plate 2 on the working surface 17, about an axis perpendicular to the working surface 17.

An imaging system 8 is configured to detect the position of the printing plate 2 and/or of the printing cylinder 4. The imaging system 8 is moreover advantageously able to detect the geometrical forms of the areas observed and to read any matrix codes (markers) present on the printing plate 2 and/or on the printing cylinder 4. The imaging system 8 comprises at least one camera 9, but preferably comprises two cameras 9. At least one camera 9 may be movably supported on displacement means 90 extending along an outlet side of the surface 17 and parallel thereto, so as to allow the imaging system 8 to be adapted depending on the format of the printing plate 2 and the printing cylinder 4 used. The means 90 for displacement of the at least one camera 9 may advantageously comprise one or more linear guides 18 and screw actuating means 19.

The alignment and driving system 5 for the printing cylinder 4 preferably comprises a pair of support uprights 23 which have respective support members 10 projecting towards each other and which are adapted to support tangentially the printing cylinder 4 at its two axial ends, such that the axis of the cylinder is arranged parallel to the outlet side 17*a* of the working surface 17. The axis of the cylinder will therefore be parallel to the axis of the rollers 6, 7 and perpendicular to a direction X of feeding of the printing plate 2.

The at least one support member 10 may comprise means for driving the printing cylinder 4 to rotate about its axis of rotation, which allows pre-registration of the position of the printing cylinder 4 with respect to the position of the printing plate 2 and allows subsequent mounting by means of displacement of the printing plate 2 on the printing cylinder 4. These means for rotationally driving the printing cylinder, which operate tangentially, are not illustrated or described in detail since they are of an obvious nature for the person skilled in the art.

The apparatus 1 further comprises means 11 for displacement of the support members 23. Advantageously, according to an important aspect of the invention, these displacement means are able to perform the displacement of the printing cylinder 4 in a direction substantially parallel to the direction in which the axis of the said cylinder lies, and therefore parallel to the outlet side 17*a*. This direction is indicated below as "transverse", in relation to the direction of feeding of the printing plate on the working surface 17. The displacement means 11 comprise advantageously one or more linear guides 20 and driving means such as screw means 21.

Elevating means 12 may also be provided for raising each support member 10 along the associated upright 23 so as to lift the printing cylinder 4 towards the working surface 17 and therefore closer to the position of the printing plate 2.

The apparatus 1 also advantageously comprises a locking element 13 adapted to exert a radial pressure against the printing cylinder 4, with the opposing action of the at least one support member 10, while allowing rotation thereof about its axis, and to clamp the printing plate against the printing cylinder 4. This locking element 13 may comprise a locking roller able to be actuated via lever pressure means 22 which are advantageously fixed to the support uprights 23.

Finally, the system 3 for pre-alignment of the printing plate 2, the system 5 for alignment and driving of the printing cylinder 4 and the imaging system 8 cooperate, managed by a suitably configured control system, to perform alignment of the printing plate 2 and the printing cylinder 4 operationally as described below.

Firstly, the operator manually sets the format of the printing plate 2 and the format of the printing cylinder 4 by means of a suitable interface, so that the system 3 for pre-alignment of the printing plate 2 and the system 5 for alignment and driving of the printing cylinder 4 automatically assume a suitable initial configuration based on the format of the printing plate 2 and the printing cylinder 4. At this point, the printing cylinder 4 is positioned on the support members 10, and the printing plate 2 on the working surface 17, in both cases manually. The printing plate is in particular aligned underneath the double rollers 6, 7 with the aid of a laser sighting device and the visual reference provided by the outlet side 17*a*. At this point the manual adjustments have been completed.

The printing cylinder 4 is then raised, via the elevating means 12, towards the printing plate 2. The position of the printing plate 2 is controlled by means of the imaging system 8. Via means for driving the printing cylinder 4, the cylinder is rotated about its axis of rotation so as to pre-register its angular position, depending on the information obtained from the imaging system 8.

At this point, the system 3 for pre-alignment of the printing plate 2 is activated by means of differential rotation of the pressure rollers 6 and 7 so as to align the printing plate 2 with respect to the printing cylinder 4. The system 5 for alignment and driving of the printing cylinder 4 is then also activated so as to align the printing cylinder 4 via the displacement means 11, with the final position of the printing plate 2.

In this position, the locking roller 13 is operated so as to lock the printing cylinder 4 on the support members 10, while allowing rotation of the cylinder about its axis. The printing cylinder 4 is then rotated by means of the driving means, while the printing plate 2 is displaced onto the printing cylinder 4 by means of the pressure rollers 6 and 7, so that mounting of the printing plate 2 on the printing cylinder 4 may be performed.

During the actual mounting step, the imaging system 8 and the system 5 for alignment and driving of the printing cylinder 4 cooperate to control and, where necessary, correct the alignment of the printing cylinder 4 with the printing plate 2, by means of suitable transverse displacements of the support members 10, i.e. parallel to the axis of the cylinder along the guides 20.

In greater detail, the procedure is performed more precisely as described below, following completion of the manual adjustments mentioned above and under the automatic control of the control system duly configured. The rollers 6, 7 move downwards, compressing the printing plate against the working surface and cause it to advance by a fixed amount so as to bring the reference markers inside the viewing field of the cameras 9.

Using the markers within the fields of vision the rollers 6, 7 perform the alignment of the said markers in the direction of feeding of the printing plate. The cameras and the cylinder, through the transverse movement of the uprights 23, are then centered with respect to the printing plate, compensating for the transverse position of the markers with respect to the center of the viewing field.

The cylinder 4 is then moved upward while the locking roller 13 instead moves downward until that roller engages with the cylinder. The step of winding the printing plate thus starts, with the cylinder 4 which rotates, the rollers 6 and 7 which in turn make rotational contact so as to accompany the printing plate 2 on the cylinder, between the latter and the locking roller 13 which exerts the necessary pressure for promoting adhesion.

During all of this winding adhesion or application step, and as a result of the advantageous possibility of transverse movement of the cylinder 4 according to the invention, the cameras read the transverse position of reference lines (or in general other geometries) arranged longitudinally (i.e. parallel to the feeding direction) on the printing plate, so as to ensure that mounting is performed correctly within the prescribed tolerances, by comparing the reading with a reference that is previously determined in the pre-alignment step. Any deviations with respect to the predetermined reference points are corrected in real time during the actual mounting operation thanks indeed to minor corrections which the control system performs, based on the signals received from the imaging system, by means of controlling the transverse movement of the uprights 23. During this operation the cameras move in a coordinated manner with the uprights 23, and thus with the printing carrier, so as to preserve the theoretical reference points to which the reference geometries have to be aligned.

When the printing plate has been fully mounted on the cylinder 4, a complete rotation is performed, during which rotation the position of the reference lines on the printing plate is measured in order to check that the maximum misalignment is less than the desired tolerances and give the operator information concerning the correctness of the mounting operation and the intrinsic position of the printing plate; since correct laying also depends on the quality of the printing plate which could be deformed by use or due to negligence.

Once these checks have been successfully completed, the cylinder 4 with its printing plate moves downwards and may be removed. The system 3 for pre-alignment of the printing plate 2 and the system 5 for alignment and driving of the printing cylinder 4 return into the initial configuration previously pre-set, in order to repeat the operations on a new printing plate 2 and printing cylinder 4 set, unless the formats have changed, in which case the operator enters manually the new data relating to the formats.

Contrary to known apparatuses then, in which e.g. according to US2012/0272848, one can have at most a transverse displacement during an initial setting or pre-alignment stage (and with no control whatsoever during the step of winding the plate over the carrier), according to the invention the transverse displacement of the cylinder is meant for an actual alignment and correction, dynamically performed to compensate possible lateral displacements of the plate in the very application step. This operation is in fact capable of compensating for all those deviations that can ensue during the application of the plate due to the mounting tolerances of the same plate and of the biadhesive material previously mounted on the carrier, tolerances that are normally not subject to any check.

It has to be also stressed that the correction procedure according to the invention is more important, as the bigger is the size of the plate, because for big sized plates, the mounting tolerances cannot be respected only by way of the mere initial alignment.

The apparatus and the method for mounting a printing plate on a printing carrier, according to the present invention, fully achieve the predefined objects in that they allow the mounting, in an automatic, precise and reliable manner, of a printing plate of any format on a printing carrier of any format.

Owing in particular to the possibility of transverse movement of the cylinder, the system ensures especially the reliable repeatability of mounting of the printing plate, ensuring the correct longitudinal, transverse and circumferential positioning thereof.

The apparatus is able to pre-set automatically all the imaging and support components before deposition of the printing cylinder or sleeve and the printing plate, using a system for pre-alignment of the printing plate which is very rigid and therefore able to ensure effective control of the mounting force and therefore allow laying of the printing plate with a constant tension. The rigid design of the pre-alignment system, without displaceable parts, is also very simple to control and therefore reliable and low-cost.

Furthermore, advantageously, the operator has free access to the support members of the printing cylinder and the work table on which the printing plate initially rests, making initial positioning of the printing plate and the printing cylinder very simple and immediate.

The present invention has been described hitherto with reference to preferred embodiments thereof. It is to be understood that other embodiments relating to the same inventive idea may exist, all of these falling within the scope of protection of the claims which are provided below.

The invention claimed is:

1. An apparatus for mounting a printing plate on a printing carrier that is a printing cylinder or a printing sleeve, the apparatus comprising:

a working surface configured for supporting the printing plate for advancing in a feeding direction of the printing plate, the working surface comprising an outlet side for outlet of the printing plate from the working surface;

a supporting and driving device for the printing carrier and arranged downstream of the outlet side in the feeding direction of the printing plate and below the working surface, the supporting and driving device for the printing carrier being configured and operative to cause rotation of the printing carrier about an axis so as to mount the printing plate in a winding and application step of the printing plate onto the printing carrier;

a pre-alignment device configured for pre-alignment of the printing plate on the working surface;

an imaging device configured to detect a position of at least one of the printing plate and the printing carrier;

a control device configured to control the pre-alignment device and the supporting and driving device as a function of information received from the imaging device; and the supporting and driving device is configured and operative to move the printing carrier in a first direction, the first direction being along the axis of the printing carrier;

wherein the control device is configured to control the position of the supporting and driving device, and consequently of the printing carrier, in the first direction, at least during the winding and application step of the printing plate onto the printing carrier.

2. The apparatus according to claim 1, wherein the device for pre-alignment of the printing plate comprises:

a pair of pressure rollers arranged coaxially with their respective axes extending parallel to the working surface and the outlet side, wherein the pressure rollers are configured to rotate independently of each other by the action of respective independent powering devices.

3. The apparatus according to claim 1, wherein the supporting and driving device for the printing carrier comprises:

a pair of mutually opposed support members configured to support the printing carrier at respective ends thereof, and support uprights movably mounted on linear guides extending transversely and associated with a second driving device configured to control displacement of the support members along the guides, wherein the support members project from respective ones of the support uprights.

4. The apparatus according to claim 3, further comprising an elevating device configured to raise each support member along a respective associated one of the support uprights for lifting the printing carrier towards the working surface.

5. The apparatus according to claim 3, wherein the support members are configured to tangentially drive rotation of the carrier about the axis thereof.

6. The apparatus according to claim 3, wherein the supporting and driving device is configured to drive the carrier and comprises:

a locking device configured to exert a radial pressure against the printing carrier along with an opposing action of the at least one support member, while allowing rotation of the printing carrier about its axis, and to clamp the printing plate against the printing carrier.

7. The apparatus according to claim 6, wherein the locking device comprises a locking roller configured to be actuated via a lever fixed to the support uprights, wherein the lever is configured to apply pressure to the locking roller.

8. The apparatus according to claim 1, wherein the imaging device comprises at least one camera; and a displacement device configured to displace the at least one camera at least along a direction transverse to the axis.

9. The apparatus according to claim 1, wherein the control device is configured to displace the printing carrier in a direction transverse to the axis when the printing carrier is centered with respect to the printing plate.

10. The apparatus according to claim 1, wherein the first direction is a linear direction transverse to the feeding direction of the printing plate.

11. A method for mounting a printing plate on a printing carrier that rotates about an axis, wherein the printing plate is arranged on a working surface and the printing plate advances along a feeding direction of the printing plate towards an outlet side of the working surface, the method comprising:

supporting the printing carrier and driving the printing carrier downstream of the outlet side of the working surface and below the working surface;

detecting the position of at least one of the printing plate and the printing carrier using an imaging device; and automatically displacing the printing carrier based on pre-set instructions, based on information received from the imaging device, wherein the displacing is in a first direction, the first direction being along the axis, so as to align the printing carrier with the printing plate when the printing plate is wound onto the printing carrier.

12. The method according to claim 11, further comprising:

reading, by the imaging device, a transverse position of longitudinal reference geometries on the printing plate when the printing plate is being wound onto the printing carrier;

comparing the reading with a reference previously determined in a pre-alignment step; and when a negative result of the comparison is obtained, displacing the printing carrier correspondingly in the crosswise first direction, and displacing the imaging device in a coordinated manner with the printing carrier to preserve a theoretical reference to which the reference geometries are to be aligned.

13. The apparatus according to claim 12, wherein the first direction is a linear direction transverse to the feeding direction of the printing plate.

* * * * *